United States Patent [19]

Childers et al.

[11] Patent Number: 4,458,680

[45] Date of Patent: Jul. 10, 1984

[54] PROTECTIVE SUPPLIED BREATHING AIR GARMENT

[75] Inventors: Edward L. Childers, Lakewood; Erik F. von Hortenau, Golden, both of Colo.

[73] Assignee: The United States of America as represented by the United States Department of Energy, Washington, D.C.

[21] Appl. No.: 383,048

[22] Filed: May 28, 1982

[51] Int. Cl.[3] ..... A62B 17/00

[52] U.S. Cl. ..... 128/201.29; 128/201.23; 128/201.25; 55/276; 55/DIG. 21; 181/258; 181/224; 181/292; 2/2

[58] Field of Search ..... 128/201.27, 201.21, 128/201.25, 201.29, 202.11, 202.19, 201.22–201.23; 2/2, 2.1 R, 2.1 A; 55/276, DIG. 21, 292; 181/258, 229

[56] References Cited

U.S. PATENT DOCUMENTS

| | | | |
|---|---|---|---|
| 3,164,840 | 1/1965 | Reynolds | 2/2 |
| 3,525,334 | 8/1970 | Braman et al. | 128/201.29 |
| 3,736,595 | 6/1973 | Siegmann | 2/2 |
| 3,769,972 | 11/1973 | Saint-Martin | 128/142.5 |
| 3,777,780 | 12/1973 | Sovornin | 128/142.5 |
| 3,818,507 | 6/1974 | Albrecht | 2/2 |
| 3,911,914 | 10/1975 | Johansson | 128/201.23 |
| 4,207,883 | 6/1980 | Shindler | 128/201.25 |
| 4,236,514 | 12/1980 | Moretti | 128/201.23 |
| 4,271,833 | 6/1981 | Moretti | 128/201.29 |
| 4,411,264 | 10/1983 | Jacobson | 128/201.25 |

FOREIGN PATENT DOCUMENTS

| | | | |
|---|---|---|---|
| 649034 | 8/1937 | Fed. Rep. of Germany | 128/201.29 |
| 2255025 | 8/1975 | France | 2/2.1 A |
| 2431865 | 3/1980 | France | 2/2.1 A |

OTHER PUBLICATIONS

Jolley, Jr., et al., *An Improved Airline Type Suppled-Air Plastic Suit*, Jun. 1978.

*Primary Examiner*—Henry J. Recla
*Assistant Examiner*—Karin M. Reichle
*Attorney, Agent, or Firm*—George H. Libman; Albert Sopp; Michael F. Esposito

[57] ABSTRACT

A breathing air garment for isolating a wearer from hostile environments containing toxins or irritants includes a suit and a separate head protective enclosure or hood engaging a suit collar in sealing attachment. The hood and suit collar are cylindrically shaped and dimensioned to enable the wearer to withdraw his hands from the suit sleeves to perform manual tasks within the hood interior. Breathing air is supplied from an external air line with an air delivery hose attached to the hood interior. The hose feeds air into an annular halo-like fiber-filled plenum having spaced discharge orifices attached to the hood top wall. A plurality of air exhaust/check valves located at the suit extremities cooperate with the hood air delivery system to provide a cooling flow of circulating air from the hood throughout the suit interior. A suit entry seal provided on the suit rear torso panel permits access into the suit and is sealed with an adhesive sealing flap.

9 Claims, 17 Drawing Figures

Fig. 8
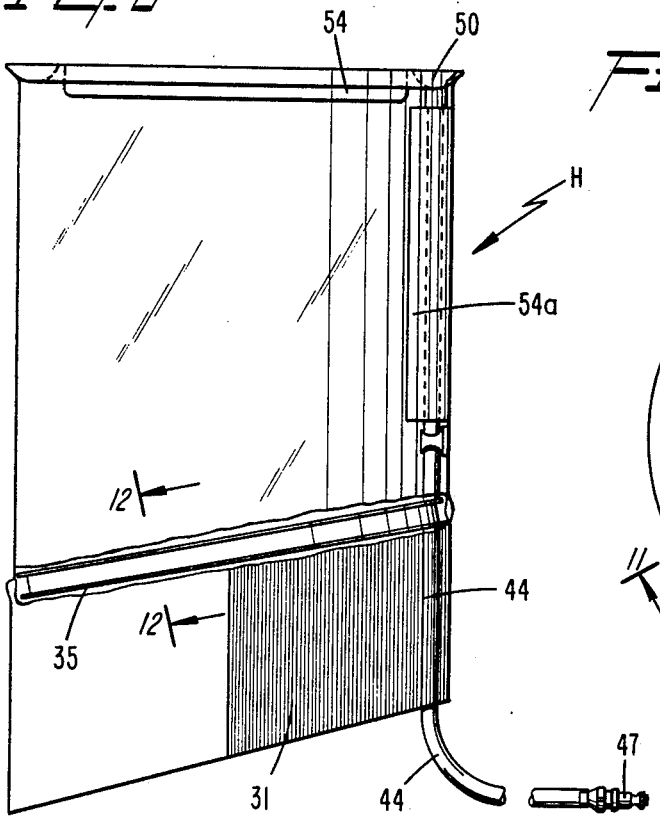
Fig. 9
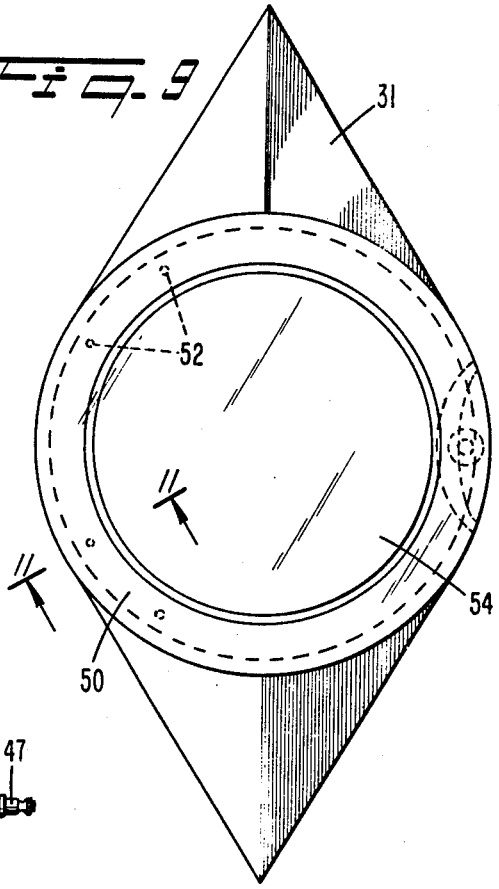
Fig. 10
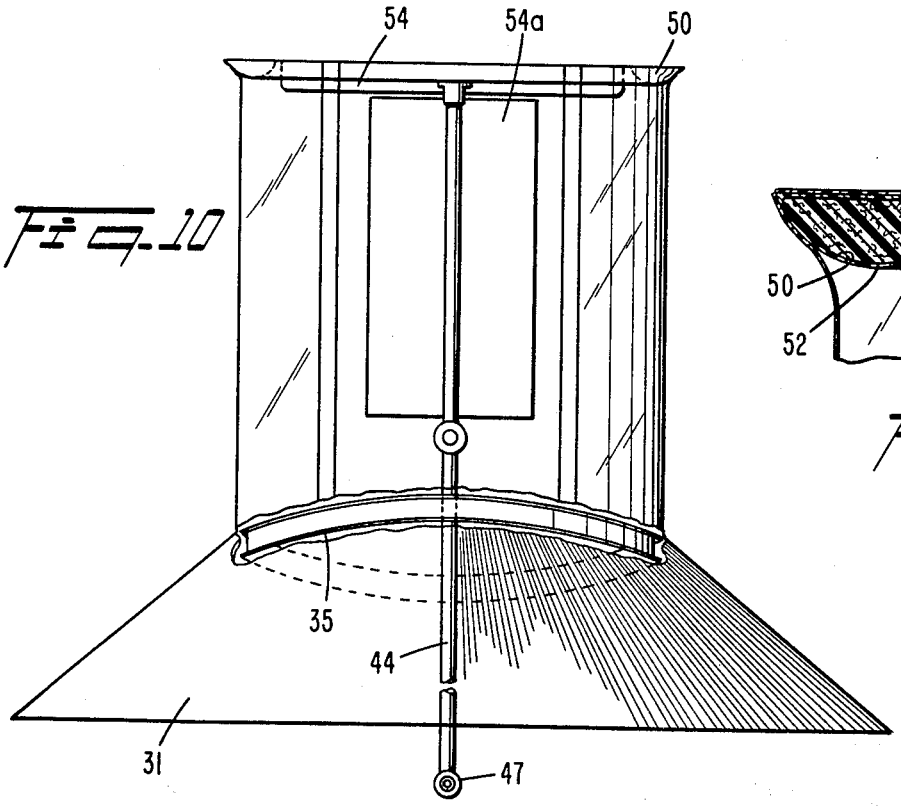
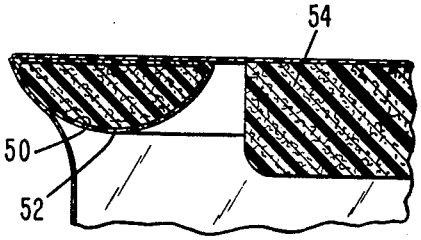
Fig. 11

Fig. 12
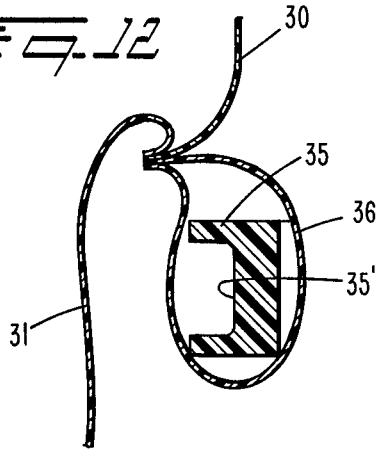
Fig. 13
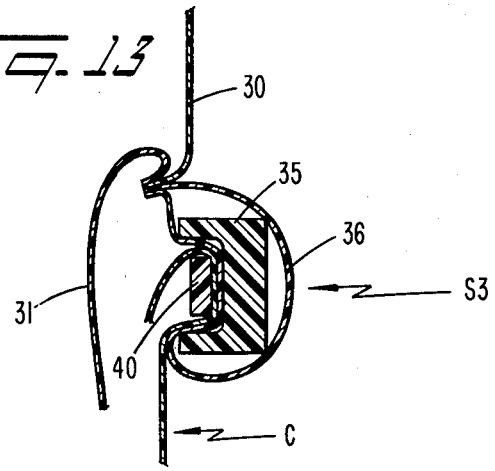
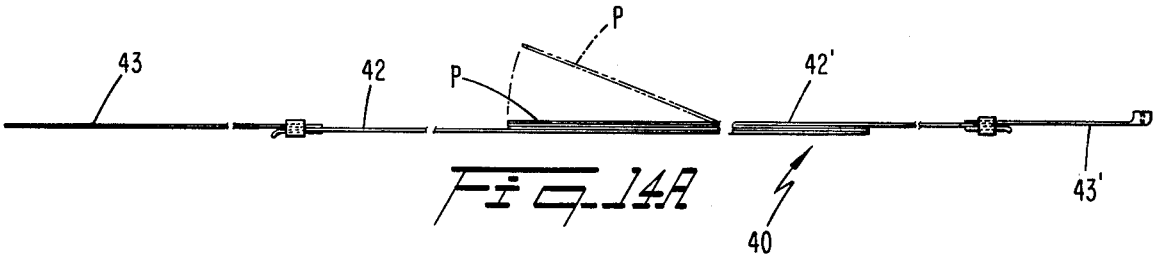
Fig. 14A
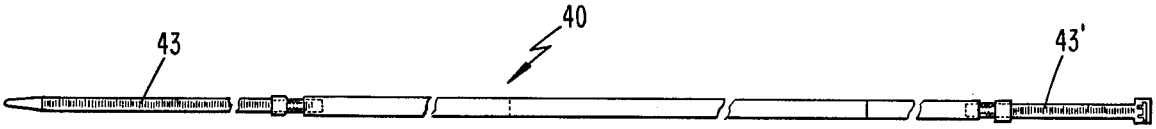
Fig. 14B
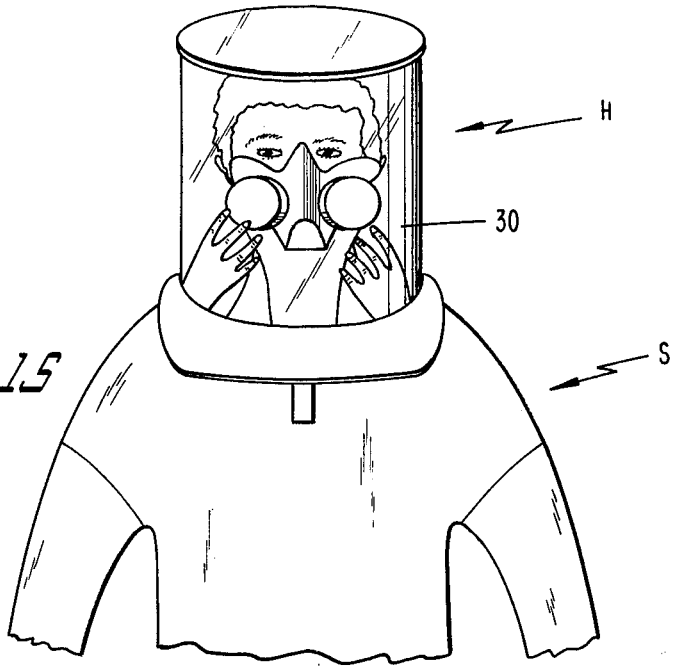
Fig. 15

PROTECTIVE SUPPLIED BREATHING AIR GARMENT

The U.S. Government has rights in this invention pursuant to Contract No. DE-AC04-76DP03533 between the U.S. Department of Energy and Rockwell International.

BACKGROUND OF THE INVENTION

This invention relates generally to garments for protecting workers operating in hostile environments containing airborne toxins or irritants and, more particularly, to a discardable air line supplied breathing air garment having improved safety features and a low noise level air delivery and distribution system.

Garments for protecting workers operating in toxic, immunological or radiological environments typically include a suit and hood to completely isolate the suited worker from contamination. An air delivery and circulation system located within the garment provides the suited worker with breathing air supplied from an external air line hose connected to the suit or a self contained breathing air supply. In prior art protective garments of which we are aware, the hood noise levels produced by air discharged into the hood interior are excessive and thus tend to inhibit the worker's safe and efficient performance and make verbal communication difficult if not impossible. In addition, such prior art systems often fail to provide a cooling flow of circulating air within the suit interior, further detracting from worker comfort and performance.

It is sometimes advantageous for a worker to perform manual tasks within the confines of the hood. For example, prior to desuiting, it is desirable to have the worker don a respirator mask while isolated from the external environment. Unfortunately, in prior art garments of which we are aware, the worker is unable to accomplish this safety procedure.

Under emergency conditions, such as when smoke or harmful components are detected within the hood interior, it is necessary for the worker to remove the hood in a rapid manner, without outside assistance, before proceeding to the nearest exit from the contaminated work area. Rapid hood removal is not easily accomplished in prior art garments of which we are aware, resulting in possible fatal consequences or unnecessary exposure of outside emergency assistants to the contaminated work environment.

SUMMARY OF THE INVENTION

It is accordingly a primary object of the present invention to provide a supplied breathing air protective garment with a low noise level air delivery system that affords a cooling flow of circulating air within the suit.

Another object is to provide a garment allowing a suited worker to perform manual tasks within the confines of the hood.

Still another object is to provide a garment including quick release features to facilitate rapid hood removal under emergency conditions.

Yet another object is to provide a garment having a component seal arrangement combined to form a rapid, safe and efficient entry and removal system for said garment.

Still a further object is to provide a garment that allows the suited worker to move over, around or under various obstacles in a rapid and unencumbered manner.

Yet a further object is to provide a garment that is capable of reliable operation in hostile environments.

Additional objects, advantages, and other novel features of the invention will be set forth in part in the description that follows and in part will become apparent to those skilled in the art upon examination of following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved apparatus is provided for isolating a worker from hostile environments including a suit and a separate head protective enclosure. The suit is formed from a protective layer of material impermeable by toxins or irritants and is dimensioned to cover the worker's torso and limbs. The head protective enclosure is connected to the suit collar with a neck seal arrangement to provide communication with the suit interior in attached position. Means are located within the head protective enclosure for delivering a breathing air supply to the head protective enclosure and air circulation means are provided for circulating the breathing flow of air from the head protective enclosure around the suited wearer for cooling.

In another aspect of the present invention, the suit is of sufficient diameter to enable the worker to withdraw his hands from the suit sleeves and to perform manual tasks within the sealed head enclosure.

In another more limited aspect of the invention, the garment includes an air delivery system including a plurality of air exhaust valves located at the suit extremity portions which cooperate to circulate air throughout the suit.

More specifically, the air delivery system includes a delivery hose fastened to the hood interior. The hose supplies breathing air from an external air line operatively connected thereto within the suit interior to an annular or halo-type plenum attached to the hood top wall. Sound muffling material provided within the plenum and sound baffles provided within the hood suppress hood noise levels, resulting in a low noise level internal delivery system.

Preferably, an annular docking rail is provided within the hood lower portion, and includes a retaining groove receiving the suit collar for sealing engagement. An adjustable docking ring compresses the suit collar within the groove to complete the seal. The docking ring includes a quick release tab engageable from outside the suit for breaking the ring in the event rapid hood removal is necessary. A quick disconnect coupling connecting the delivery hose to the external air line is also quickly releasable to facilitate rapid hood removal.

The suit of the invention also includes a suit entry seal having a vertical slit bisecting the suit collar and rear torso panel. An adhesive sealing flap seals the slit after the worker enters the suit. A pair of pull tabs connected to the suit collar and sealing flap serve to break the entry seal when the worker desuits. The primary purpose of these tabs is to allow an assistant, wearing protective gloves, to begin peeling the adhesive flap off.

A retaining nipple on the exterior of the rear torso panel receives the external air line in sealing contact. An adhesive tail flap formed on the sealing flap covers the nipple and connecting portion of the air line.

Still other objects of the present invention will become readily apparent to those skilled in the art from the following description wherein there is shown and described a preferred embodiment of this invention, simply by way of illustration of one of the best modes contemplated for carrying out the invention. As will be realized, the invention is capable of other different embodiments, and its several details are capable of modifications in various obvious aspects all without departing from the invention. Accordingly, the drawings and description will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings:

FIG. 8 is a side view of the transparent hood showing the air delivery system and location of the docking rail;

FIG. 9 is a top view of the hood shown in FIG. 8;

FIG. 10 is a rear view of the hood;

FIG. 11 is a view taken through the line 11—11 of FIG. 9 showing the positioning of a sound baffle (partially broken away) in relation to the hood plenum;

FIG. 12 is a partial, cross-sectional view of the docking rail on the suit collar and in sealing contact with the docking rail;

FIG. 13 is a view similar to FIG. 12 showing the docking rail on the suit collar and in sealing contact with the docking rail;

FIGS. 14A and 14B are respectively side and top views of the docking ring used to compress the suit collar into engagement with the docking rail; and FIG. 15 is a partial illustration of the suited worker performing manual tasks within the hood interior.

Reference will now be made in detail to the present preferred embodiment of the invention, an example of which is illustrated in the accompanying drawings.

DETAILED DESCRIPTION OF THE INVENTION

Figure 1:
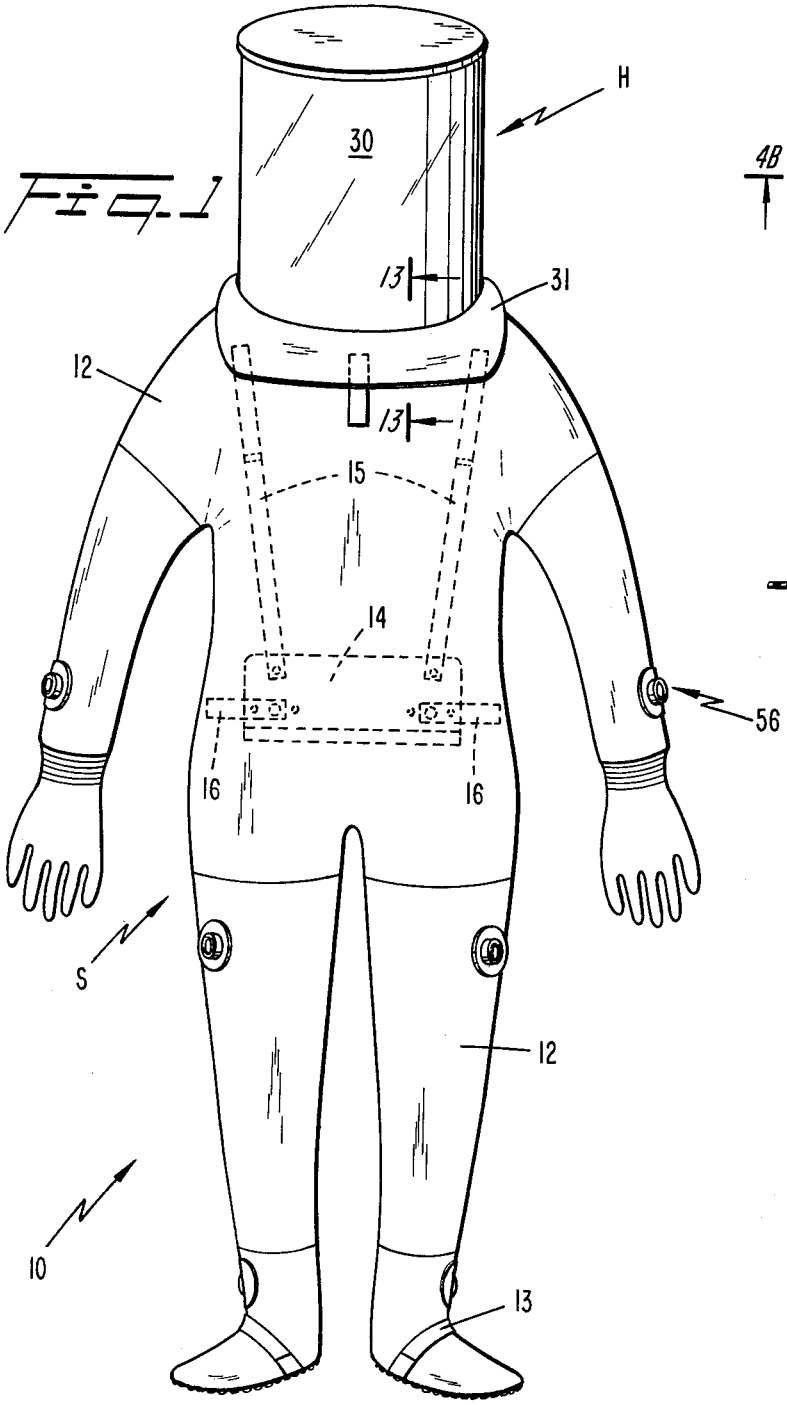
FIG. 1 is a front view of the protective garment of the invention showing the hood attached to the suit and location of multiple air exhaust valves.

Referring to FIG. 1, an improved air line type supplied air garment, generally designated with reference numeral 10, is shown for use in protecting workers from environments containing toxins or irritants. Garment 10 basically comprises a separate head protective enclosure or hood H and a suit S that cooperate to provide a low noise level air delivery system for breathing and a cooling flow of air around the wearer. In accordance with the unique features set forth below, garment 10 also allows the worker to perform tasks with his hands within hood H while sealed within the suit, and enables the worker to exit the suit quickly in emergency situations.

Figure 2:
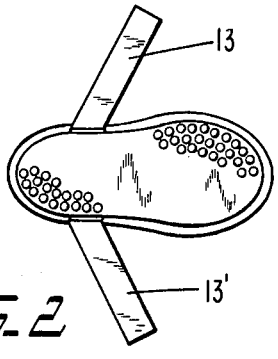
FIG. 2 is a bottom view of the suit booties and adjustment straps therefor.

As shown in FIGS. 1 and 2, suit S is preferably of one piece construction and includes a protective sheeting 12 covering the worker's torso, arms and legs. Protective sheeting 12, forming the suit body material, is preferably soft, PVC sheeting of approximately 0.012 inch thickness. Suit S is formed from separate parts that are radio frequency heat sealed together to obtain a minimum seam strength of approximately 750 PSI. Booties are integrally attached to the suit body. Separate gloves are attached and sealed by engagement with mating cuffs on the sleeves (see FIG. 3) whereby the top of the glove fits over a ridge on the semi-rigid cuff and the connecting ends are then sealed with 1.5-inch wide, 7-mil thick, pressure sensitive, PVC adhesive tape. A pair of adjustment straps 13 and 13' are provided on the instep of each bootie to assure a proper fit.

To accomodate the worker's particular size requirements, front and rear girdle panels 14 and 14' (see FIGS. 1 and 5) are respectively provided on the pant section of suit S. Girdle panels 14 and 14' are heat sealed to the suit interior. A pair of girth straps 16 are secured to the rear panel 14' to encircle the waist for attachment to the front panel 14. Each strap is preferably connected to one of a plurality of snap fasteners on the front panel to obtain the desired fit. A pair of adjustable suspender straps 15 complete the necessary size adjustment of the suit S to the particular wearer.

A suit entry seal S1 (see FIG. 6) is provided on the rear torso panel of suits S to fully seal the suited worker from the outside environment. As shown, the entry seal S1 provides a vertical slit 20 when open bisecting and extending downwardly from the suit collar C to a point above rear girdle panel 14'. A sealing flap 22 provided with an inwardly facing pressure sensitive adhesive surface assures positive sealing closure of entry seal S1 after the worker has entered the suit. The flap 22 folds over the seal S1 from the open position of FIG. 6 to the closed and covering position of FIG. 5.

Figure 7:
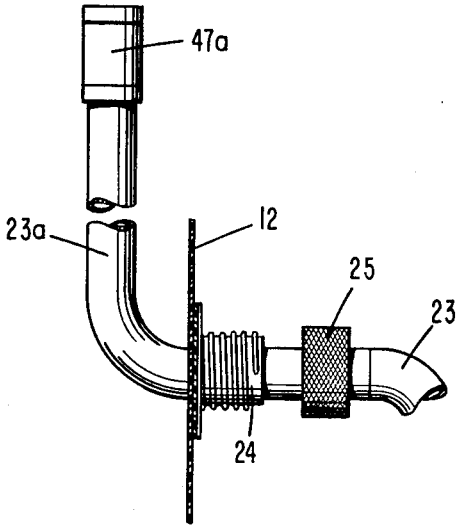
FIG. 7 is a detailed view of the air line retaining nipple provided on the rear torso panel of the suit.
Figure 6:
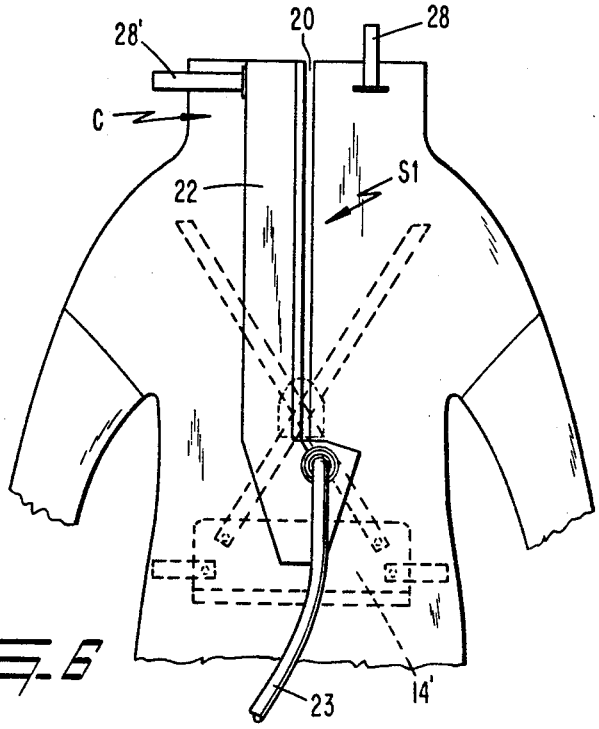

An external air supply line or hose 23 provides a flow of breathing and circulating air to the worker in the garment 10. As shown in FIG. 7, hose 23 is attached to the sheeting 12 of the suit S with a retaining nipple 24 externally provided on the suit. Nipple 24 is externally threaded to receive a threaded female collar 25 provided on hose 23 (see FIG. 7), the nipple and collar forming an air-tight seal between suit 10 and hose 23. As shown in FIG. 6, the air line entry point is located adjacent the lower end of the slit 20 on the rear torso panel.

Figure 5:
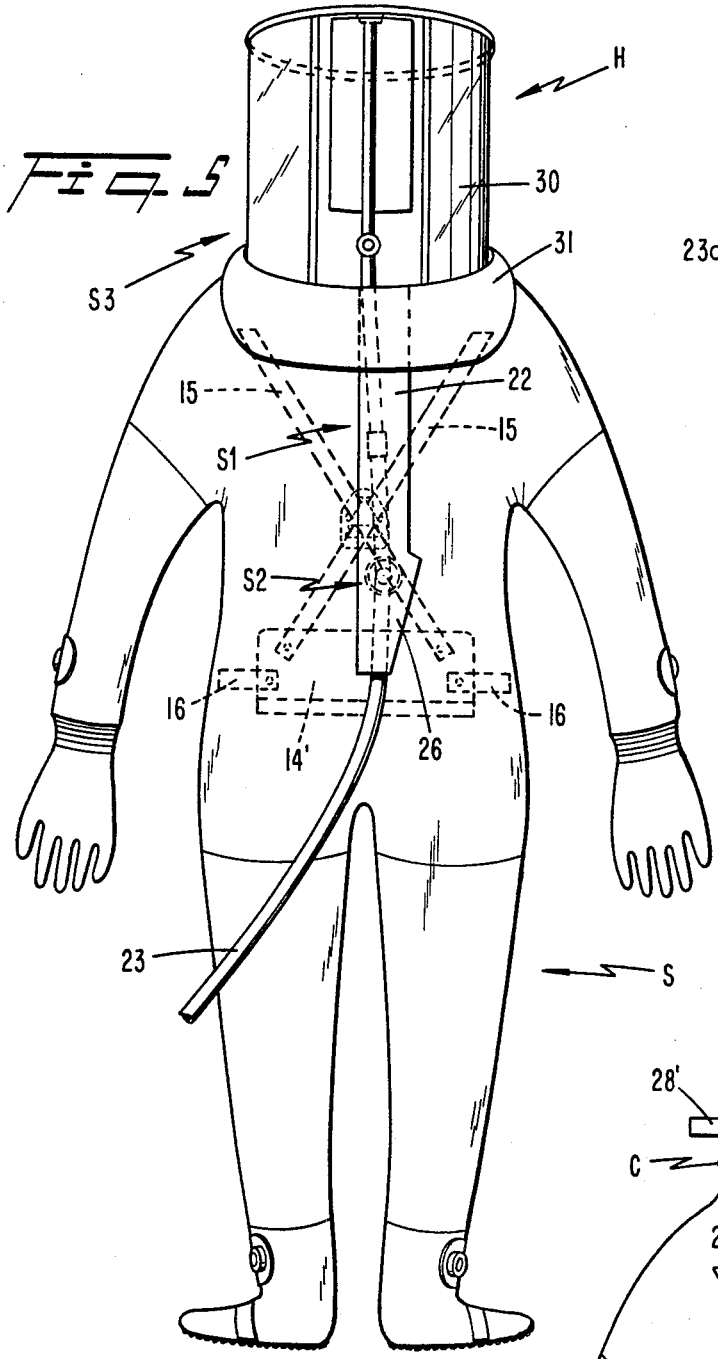
FIGS. 5 and 6 are rear views of the protective garment showing the location of the suit entry and air line attachment on the rear torso panel.

To minimize the likelihood of contamination through the nipple, an air line seal S2 includes an adhesive coated tail flap 26 integrally formed on the lower end of sealing flap 22 (see FIG. 5). Thus, after sealing flap 22 is positioned to fully cover the vertical slit 20, the tail flap 26 extends to cover the air line entry point in adhesive sealing engagement. The remaining adhesive portions of tail flap 26 are wrapped around the hose to prevent contamination of the hose where it enters the suit.

A pair of pull straps 28 and 28' (see FIG. 6) are secured to suit collar C to permit the worker rapid egress from suit S. One pull strap 28 is attached to the rear upper portion of suit collar. The second pull tab 28' is attached laterally to the upper portion of sealing flap 22 in the vicinity of the suit collar. These tabs are pulled in opposite directions by an assistant wearing protective gloves to open seal S1 and permit the wearer to exit the suit.

Referring now to the head protective enclosure, hood H includes a transparent cylinder 30 defining side walls for unobstructed viewing and a circular top or upper wall peripherally joined thereto. Preferably, hood cylinder 30 and the top wall are formed from clear PVC sheeting, preferably clear pressed-polished PVC to define an optical portion extending circumferentially for approximately 315 degrees. The diameter of hood H corresponds to the diameter of suit collar C enabling the two parts to be attached and sealed together.

In accordance with an important aspect of the invention, and as shown in FIG. 15, the diameter of this opening between the suit S and hood H is sufficient to allow the worker to withdraw his hands from the suit sleeves to perform tasks within the hood interior. In other words, the spacing between the wearer's body and the neck area, as well as the upper torso area, is large enough to allow the hands to be pulled up out of the sleeves, moved up along the chest and through the opening to the hood and around the face. A separate breathing mask carried inside the suit can thus be donned before the suit is removed to further insure the safety of the wearer. Of course, with this feature, other necessary tasks requiring the hands around the head can be performed.

A hood cape 31 attached to the lower peripheral edge of the cylinder 30 hangs downwardly therefrom to provide additional protection for the seal between the hood and suit.

In accordance with the invention, an annular docking rail 35 is located along the lower peripheral edge of the hood cylinder 30 to form a neck seal S3 between hood H and suit collar C. As best shown in FIGS. 12 and 13, docking rail 35 is located within a peripheral pocket 36 attached to the lower edge of the hood cylinder 30. An annular retaining groove 35' is formed in the docking rail 35 to receive suit collar C in sealing engagement, whereby the suit collar C is pressed into the groove 35' and an adjustable docking ring 40 is placed on top of the collar in the groove (see FIG. 13).

As shown in FIGS. 14A and 14B, the docking ring 40 is preferably formed from a pair of PVC strips 42 and 42' overlapping each other and heat sealed together. A pull tab P formed by not sealing one of the overlapping ends can be operated to break the heat seal (note phantom lines in FIG. 14A). Tab P advantageously serves as a quick release feature to break the docking ring in the event that rapid removal of hood H becomes necessary.

A pair of tie extensions 43, 43' are connected to the free ends of the strips 42, 42'. A suitable clasp means is provided on the end of the one tie extension 43' and receives the other tie extension in adjustable tight fastening engagement when the docking ring is positioned within the retaining groove 35'. The tie extensions 43, 43' may be a conventional plastic pipe or cable tie separated in the middle and attached, such as by a conventional cord clamp, to the ends of the strips 42, 42'. When the docking ring 40 is placed in position, as indicated above, the suit collar C is drawn tight within groove 35' in sealing engagement with the docking rail, thereby assuring a proper neck seal (see FIG. 13).

Breathing air is supplied to the interior of garment 10 from the external air supply hose or line 23, as mentioned briefly above. Hose 23 is connected to the internal air distribution system of the invention by air line extension **23*a* (see FIG. 7) extending through the retaining nipple 24. An air delivery hose 44 is fastened adjacent to the rear of the hood with suitable clamps, as best shown in FIGS. 8 and 10. The hose 44 extends vertically below cape 31 and includes a male coupling member (see FIG. 8) to connect the hose to the mating female coupler 47*a* on the supply hose end located within suit S. The coupling member 47** and coupler may be any suitable quick disconnect style that is readily available.

As shown in FIGS. 8–10, the upper end of hose 47 is connected to a halo-shaped plenum or chamber 50 secured to the interior surface of the top wall of the hood H. The plenum is filled with resinated polyester fiber batting to suppress the noise of air discharging from hose 44 into the plenum. A plurality of air distribution orifices 52 are located in the lower wall of the plenum 50 in substantially equispaced relationship to provide an even distribution of breathing air from the plenum into the hood. The air continues down around the neck and shoulders flowing to all sides of the body, thus keeping the entire body comfortably cooled.

In the embodiment shown in FIG. 9, airflow of 6 cfm enters suit 10 through four orifices 52 spaced around the front half of hood H. The semi-cylindrical blanket of air prevents the wearer's exhaled breath from condensing on the optical portion of the hood and thereby obscuring his field of vision. In this embodiment, oval orifices of approximately $3\times6$ mm were found to reduce the noise level to acceptable levels. Of course, it is contemplated that other arrangments of holes, such as completely around the hood to provide a cylindrical blanket of air, and hole shapes, may be used to provide the wearer with a comfortable working environment.

A pair of sound baffles 54 and 54' are respectively provided on the top and back interior surfaces of the hood, as shown in FIGS. 8–11. Sound baffles 54 and 54' suppress noise by absorbing the sound generated by the flow of air described above. The sound baffles are preferably formed from resinated polyester batting of approximatley one inch thickness. The top baffle is round and positioned within the circle defined by the plenum 50. The baffle **54*a* on the back surface is rectangular and absorbs additional sound bounced off the interior cylindrical surface of the hood H. The baffle 54*a* overlies the hose 44** isolating the noise of the air flowing inside and thus further reducing the noise level. With this design, sound levels within hood H in the approximate range of 62–79.5 dba (decibels) can be obtained, at corresponding air delivery flow rates of approximately 4–10 cfm (cubic feet per minute).

Figure 4A:
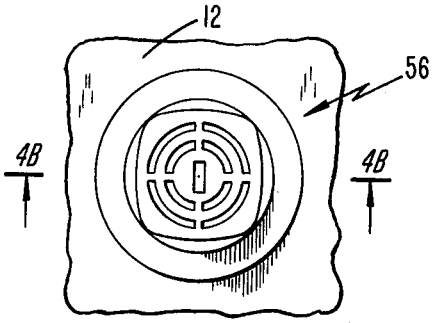
FIGS. 4A and 4B are respectively top and cross-sectional views of the air exhaust valves.
Figure 4B:
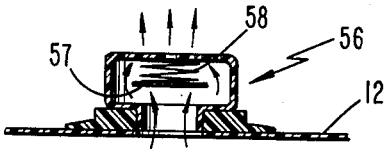
Figure 3:
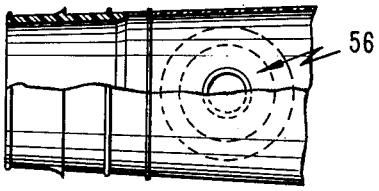
FIG. 3 is a detailed view of the end portion of the suit sleeve showing the location of an air exhaust valve above the cuff thereof.

The cooling flow of air around the wearer flows to a plurality of air exhaust/check valves 56 (see FIGS. 4A and 4B) attached to the suit extremities; i.e. one valve on each sleeve, leg and foot in suit S (see FIGS. 1, 3, and 5). Valves 56 allow air to constantly flow out of the garment by lifting flapper element 57 against the closing force of a spring 58. (Although a coil spring is illustrated, spring 58 may be of any known construction.) One type of valve capable of reliable operation in the above manner is available from Mine Safety Appliances Company, Pittsburgh, Penna. (part no. 83365). The constant outflow of air prevents entry of ambient gas contaminant. If the air pressure inside the garment 10 drops sufficiently to allow the valves 56 to close (the spring acting to seat the valve flapper), the entry of the gas contaminant is therefore prevented. Also, if the air to only one extremity is temporarily interrupted, such as by bending of the arm or leg into an unusual position, the valve 56 on that extremity automatically closes.

Positioning of the valves advantageously contributes to user comfort by permitting a cooling blanket flow of air to circulate down from hood H, through the suit collar C and throughout the suit S around the wearer to reach the valve locations. The feature of injecting the blanket of air into the hood H through the halo-shaped fiber-filled plenum 50 coupled with the constant outflow of the air at the extremities provides desired high capacity, low noise operation not attainable with the prior art systems.

In operation, a worker may suit and desuit with garment 10 of the invention as follows. To don the suit, the worker inserts his legs in the pants section and fastens the external adjustment straps 13, 13'. The suspenders 15 and girth straps 16 on the suit S are then adjusted. Air supply hose 23 with extension **23*a* is brought through the threaded nipple opening and the threaded connector collar 25 is screwed onto the nipple 24 in sealing engagement. The hood H is then placed over the head with the protective cape 31 turned up. The end of the air supply hose extension 23*a* is then attached to the male connector 47 provided on the interior hose 44. Next, the protective paper backing is removed from the adhesive flap 22, the seal S1 brought together and the flap 22 folded over, thus sealing entry seal S1. The backing of the adhesive tail flap 24 is removed and the flap is wrapped around nipple 24 and air supply hose 23 so that the suit hose entry S2 and approximately one foot of hose 23** are also completely sealed.

Suit collar C now extends around docking rail 35. The docking ring 40 is positioned within the retaining groove 35' and tightened so as to clamp the suit collar within the groove in tight sealing relationship. The upper end of suit collar C is now pulled down over docking ring 40. Hood cape 31 is pulled down over the user's shoulders to complete the neck seal S3.

The wearer is now completely sealed inside the suit in isolation form the contaminated environment. As mentioned above, hood H and suit collar C are of sufficient diameter to enable the suited worker to remove his hands from the suit to perform tasks with his hands within the hood. This feature is of particular importance in providing the ability to don a respirator mask before removing the suit.

To desuit after normal use, the hood cape 31 and the down turned portion of suit collar C are raised to expose hood locking ring 40. The docking ring is removed, breaking the seal S3. The pull tabs 28, 28' are engaged to pull the sealing flap 22 and tail flap 26 apart, opening seals S1, S2. The hood and suit are then removed in accordance with proper decontamination procedures.

In cases of extreme emergencies (i.e. smoke or fumes within the hood), the garment 10 of the invention enables the worker to don a respirator and remove the hood in a rapid manner. The quick release tab P on docking ring 40 is pulled to remove the ring from docking rail 35, enabling the worker to pull the hood off. After disconnecting the interior delivery hose 44 from supply air hose extension **23*a*, via the quick disconnect coupling 47, 47*a***, immediate evacuation to the nearest exit away from the contaminated area may be made.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

We claim:

1. A breathing garment for isolating a wearer from hostile gaseous environments, said garment comprising:

a one-piece suit formed from material impermeable by the hostile environments and dimensioned to cover at least the torso of a wearer, said suit having a suit collar for surrounding the neck of the wearer;

a hood having an upper wall and side walls for enclosing the head of the wearer connectable to said suit collar;

means for providing an airtight seal between the interior and exterior of said garment at the connection of said hood and said collar;

air line entry means for coupling to a free end of an air supply hose, said air line entry means forming an opening in the suit material; and an air circulation system comprising:

an air delivery hose means for delivering air from said entry means to said hood;

an annular plenum secured to said upper wall of said hood and adapted to be above the head of the wearer and connected to said delivery hose means, said plenum being filled with resonated polyester fiber batting and having a plurality of spaced orifices for even distribution of air into the interior of said garment;

a first sound baffle secured to said upper wall of said hood and surrounded by said annular plenum;

a second sound baffle positioned on an interior surface of said side walls of said hood adapted to lie behind the wearer's head, both said sound baffles being formed of resonated polyester fiber batting; and a plurality of air exhaust/check valves located along said suit, said valves providing for release of air from said garment.

2. The garment of claim 1 wherein said suit also includes sleeves and legs for covering the arms and legs of the wearer, and at least one of said plurality of valves is located along each sleeve and leg of said suit.

3. A breathing garment for isolating a wearer from hostile gaseous environments, said garment comprising:

a one-piece suit formed from material impermeable by the hostile environments and dimensioned to cover at least the torso of a wearer, said suit having a suit collar for surrounding the neck of the wearer;

a hood for enclosing the head of the wearer connectable to said suit collar;

neck sealing means for attaching said hood to said collar, said neck sealing means comprising:

an annular docking rail secured to a lower peripheral edge of said hood, said rail having a retaining groove to receive said collar; and a docking ring including opposed end portions, a connecting portion between and connected to said end portions, and means for fastening said end portions together to compress said collar into tight sealing engagement with said retaining groove, said connecting portion comprising a pair of overlapping strip members attached together in sealing engagement, one of said members having a quick release pull tab engageable from outside the suit to separate the strip members, thereby releasing the docking ring from sealing engagement with the docking rail and enabling the quick removal of the hood under emergency conditions.

4. The garment of claim 3 wherein said suit includes sleeves which cover the arms of the wearer, said sleeves, collar and hood being of sufficient size to enable the wearer's hands to be withdrawn from the sleeves and moved into the hood.

5. A breathing garment for isolating a wearer from hostile gaseous environments, said garment comprising:

a one-piece suit formed from material impermeable by the hostile environments and dimensioned to cover at least the torso of a wearer, said suit having a suit collar for surrounding the neck of the wearer;

a hood for enclosing the head of the wearer connectable to said suit collar;

means for providing an airtight seal between the interior and exterior of said garment at the connection of said hood and said collar;

air line entry means for coupling to a free end of an air supply hose, said air line entry means forming an opening in the suit material; and a suit entry seal comprising a slit in said suit bisecting said collar and extending to said opening of said air line entry means, and a sealing flap having adhesive means for covering and sealing the slit, the air line entry means, and adapted to cover the free end of an air supply hose attached to said entry means after the wearer dons said suit.

6. The garment of claim 5 wherein said suit includes a rear torso panel and said air line entry means is located on said rear torso panel which covers the back of the wearer, and said slit extends vertically from said collar to said entry means.

7. A garment according to claim 5, wherein said suit entry seal further includes first and second pull straps secured adjacent the suit collar, said pull straps being engageable to break the suit entry seal to thereby remove the suit.

8. A garment according to claim 5, wherein said air line entry means comprises a retaining nipple provided on the exterior of the suit.

9. A garment according to claim 8, wherein said sealing flap includes an adhesive tail flap descending downwardly from the sealing flap, said tail flap being positionable to cover the nipple in sealing engagement.

* * * * *